US006739891B2

(12) United States Patent
Itoh

(10) Patent No.: US 6,739,891 B2
(45) Date of Patent: May 25, 2004

(54) STRUCTURE FOR CONNECTION OF HARNESSES IN VEHICLE

(75) Inventor: Nozomi Itoh, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/386,601

(22) Filed: Mar. 13, 2003

(65) Prior Publication Data

US 2003/0176092 A1 Sep. 18, 2003

(30) Foreign Application Priority Data

Mar. 15, 2002 (JP) ..... 2002-072162

(51) Int. Cl.[7] ..... H01R 29/00
(52) U.S. Cl. ..... 439/174; 439/247; 439/248
(58) Field of Search ..... 439/174, 247, 439/248, 246, 544, 364, 34

(56) References Cited

U.S. PATENT DOCUMENTS 5,205,755 A * 4/1993 Douty et al. ..... 439/247
5,904,441 A * 5/1999 Kodama et al. ..... 403/337
6,017,233 A * 1/2000 Fry et al. ..... 439/248

FOREIGN PATENT DOCUMENTS

JP 2001-328493 A 11/2001
JP 2002-002414 A 1/2002

* cited by examiner

*Primary Examiner*—Tho D. Ta
(74) *Attorney, Agent, or Firm*—Foley & Lardner LLP

(57) ABSTRACT

A structure for connection harnesses in a vehicle comprises a cockpit module including a component which is assembled in an instrument panel, a first connector which is connected with an end of a harness disposed in a passenger compartment and which is attached to said component of the cockpit module, a second connector which is connected with an end of a harness disposed in an engine room and which is connectable with said first connector, and a dash panel which divides said passenger compartment and engine room and which includes a connector through-hole in which said first connector or second connector is inserted. The first connector is arranged to face said connector through-hole when said cockpit module is attached in a front part of said passenger compartment. The second connector is insertable in said first connector from the side of said engine room.

9 Claims, 5 Drawing Sheets

STRUCTURE FOR CONNECTION OF HARNESSES IN VEHICLE

BACKGROUND OF THE INVENTION

1. Field of the Invention

The present invention relates to a structure for connection of harnesses in a vehicle such as an automobile, more specifically, to a structure for connection of harnesses which are used to connect electrically and mutually instruments such as a meter, an air conditioner and so on.

2. Description of the Prior Art

Hitherto, there is known a structure for connecting a compartment harness which is cabled in a passenger compartment in a vehicle such as an automobile and an engine room harness which is cabled in an engine room in the vehicle, for example, as disclosed in Japanese Patent Laid-Open Publication No. 2001-328493 or Japanese Patent Laid-Open Publication No.2002-2414.

The publication No. 2001-328493 discloses a structure in which some modules for electrical instruments are installed in a passenger compartment and an engine room in a vehicle and these modules are connected within the passenger compartment by means of harnesses cabled in the passenger compartment and engine room, without using any connector. However, in such a structure, because the harnesses disposed in the engine room must be extended through holes provided in a dash panel (dash board) into the passenger compartment, it is very difficult to insert the harnesses into the holes in the dash panel. Workability of wiring the harnesses is inefficient in the aforementioned structure.

On the other hand, the publication No. 2002-2414 discloses a structure in which an electrical box is disposed in a passenger compartment and is fixed to a dash panel. The electrical box has a first connector connectable with a connector for a harness in an engine room, a second connector connectable with a connector for a harness in the passenger compartment and a circuit for connecting the first and second connectors. However, in such a structure, because the electrical box is fixed to the dash panel within the passenger compartment, a space of the passenger compartment becomes narrow. This is especially true in a recent vehicle which has a configuration in which a cockpit module (which is consisted by sub-assembling an air conditioning unit in an instrument panel) is disposed at the front part of the passenger compartment, namely, adjacent to the dash panel. There is a disadvantage that a space of wiring the harnesses in the passenger compartment is further eliminated due to the presence of the electrical box and, therefore, operation for connecting the harnesses becomes very difficult, in the aforementioned configuration disclosed in publication No. 2002-2414.

The structure in the publication No. 2002-2414 is also complicated since the electrical box has the first connector, the second connector and the circuit for connecting the first and second connectors.

Further, in the conventional structures as described, work of connecting the harnesses must be carried out in a narrow space in a lower side of the instrument panel in the passenger compartment and therefore workability is inefficient.

SUMMARY OF THE INVENTION

It is, therefore, an object of the present invention to provide a structure for connection of harnesses in a vehicle such as an automobile, which is capable of connecting easily a harness in a passenger compartment and a harness in an engine room, within the engine room in which a space of working is relatively easy to obtain.

To accomplish the above object, a structure for connection harnesses in a vehicle according to the present invention comprises a cockpit module including a component which is assembled in an instrument panel, a first connector which is connected with an end of a harness disposed in a passenger compartment and which is attached to the component of the cockpit module, a second connector which is connected with an end of a harness disposed in an engine room and which is connectable with the first connector, and a dash panel which divides the passenger compartment and engine room and which includes a connector through-hole in which the first connector or second connector is inserted.

Here, the first connector is arranged to face the connector through-hole when the cockpit module is attached in a front part of the passenger compartment and the second connector is insertable in the first connector from the side of the engine room.

In one embodiment, the above structure further comprises a connector bracket to which the first connector is attached and which is attached to the component of the cockpit module.

As an example, the connector bracket is integrally formed on a front surface of said component. The first connector is mounted adjustably and movably in forward and reward and upward and downward and rightward and leftward directions on said connector bracket.

The first connector has an insertion-guide part for said second connector. The first and second connectors hold together a peripheral part of the connector through-hole of said dash panel. The second connector is provided with an annular sealing member which is subjected to a compressed force occurred between both the connectors when the second connector is connected wit the first connector. The annular sealing member seals the peripheral part of the connector through-hole and a periphery of a fitting part in both the connectors under action of a force due to holding of the dash panel by the connectors.

The first and second connectors are connected at a central part of the dash panel in width direction of the vehicle.

DETAILED DESCRIPTION OF THE PREFERRED EMBODIMENTS

Hereinafter some preferred embodiments of the present invention will be explained in detail in connection with the accompanying drawings.

Figure 1:
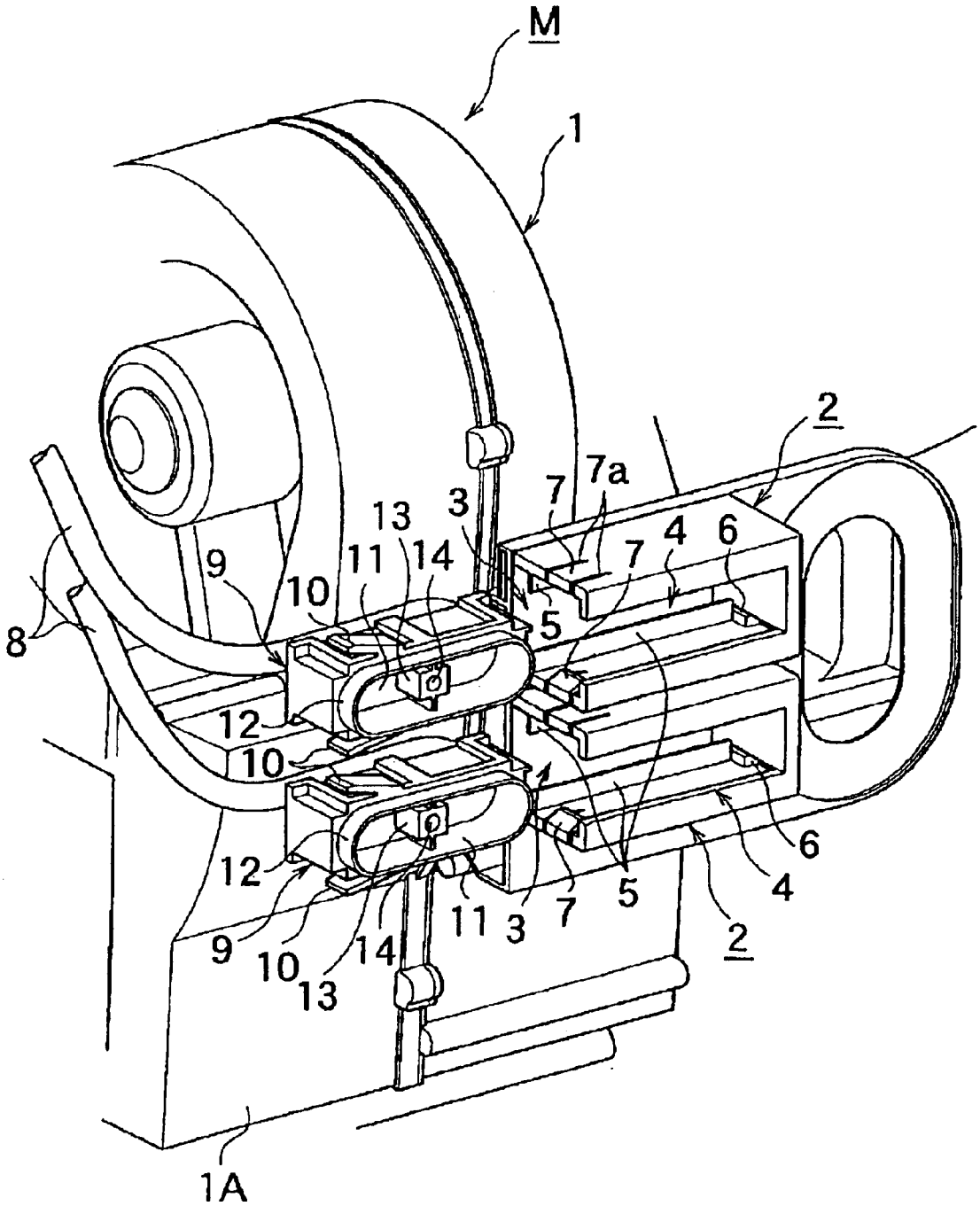
FIG. 1 is a perspective view showing a relationship between a connector bracket and a first connector in a first embodiment of the present invention.
Figure 2:
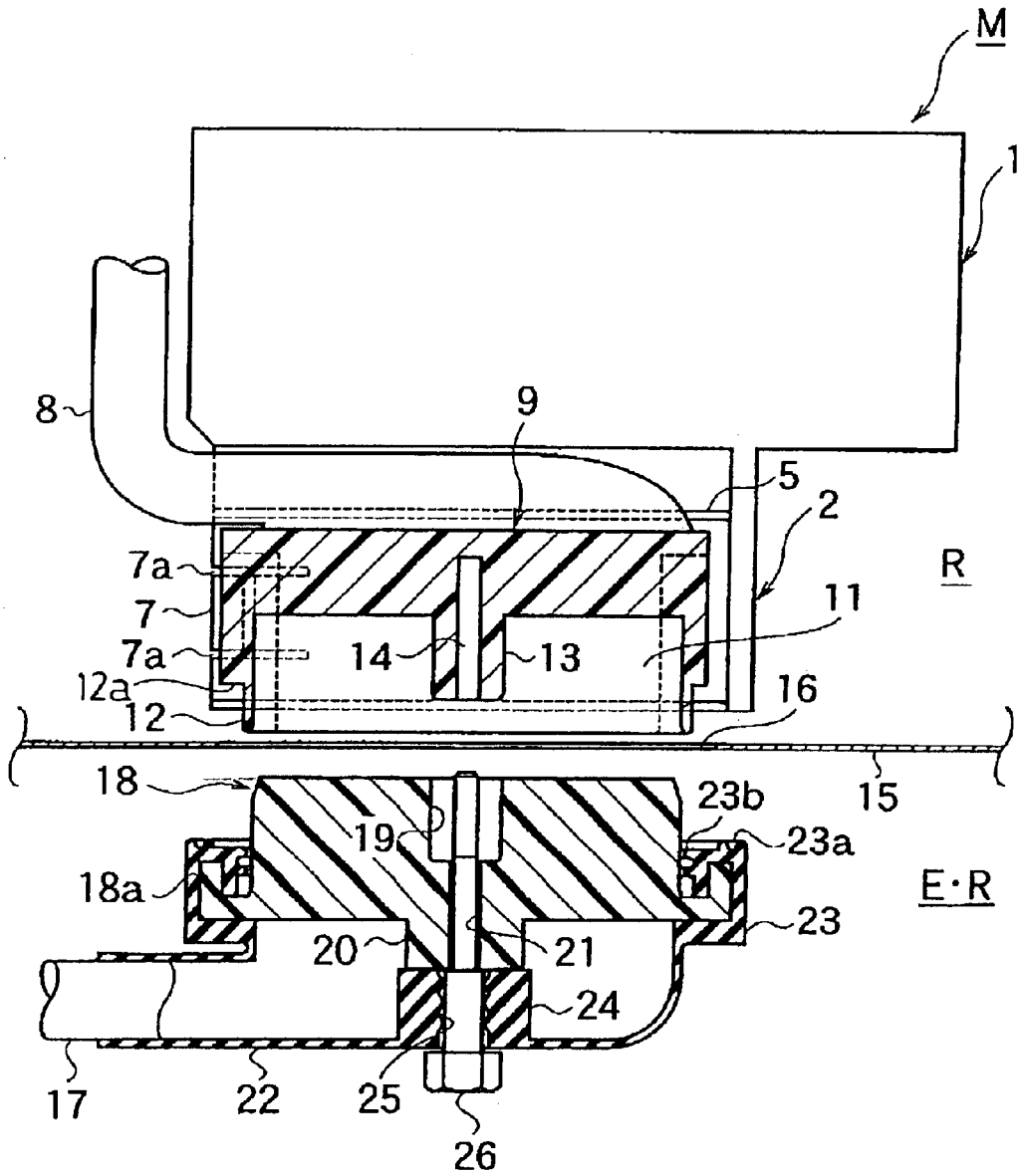
FIG. 2 is a front view showing a state before the first connector and a second connector are fitted in the first embodiment of the present invention.
Figure 3:
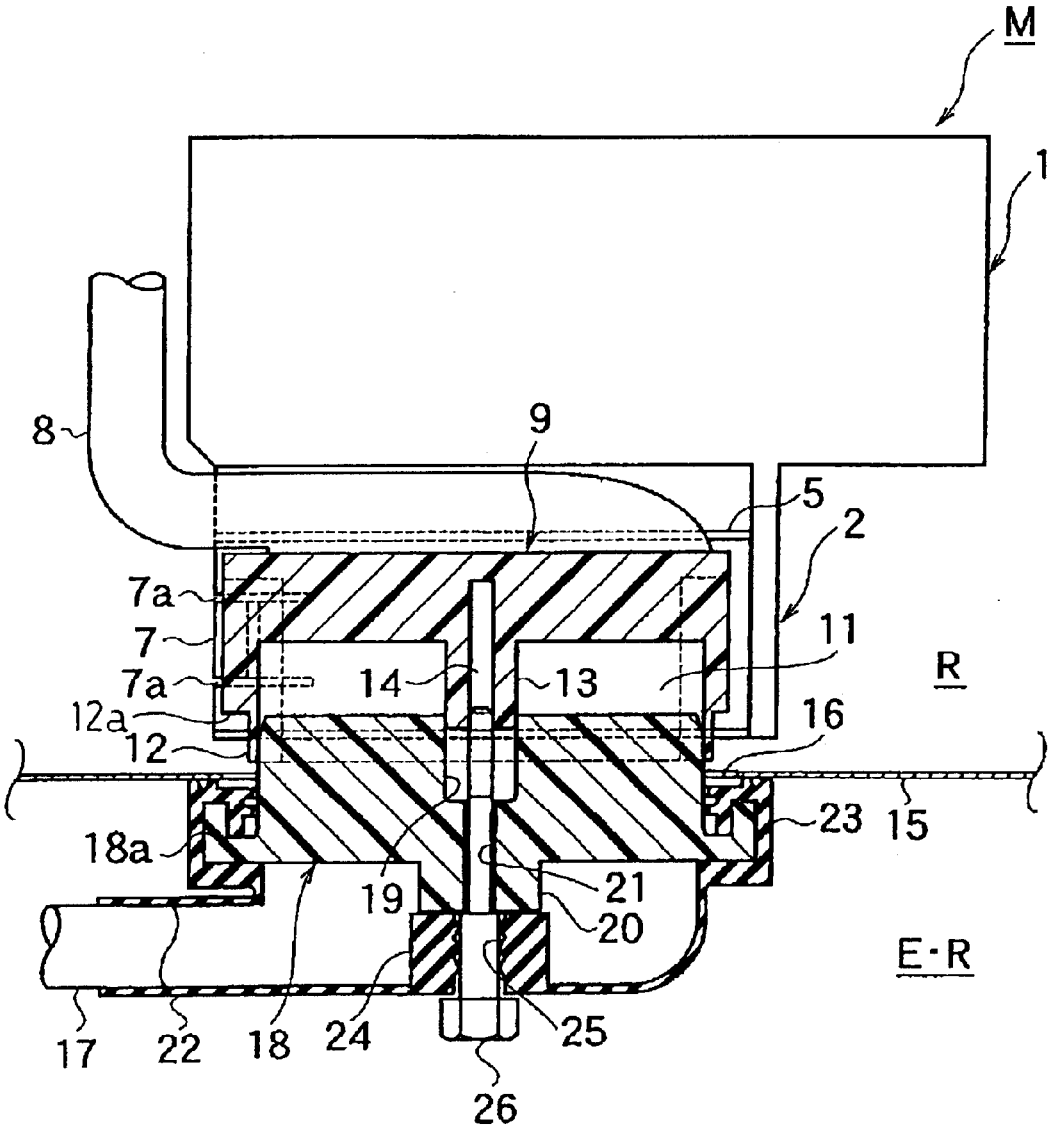
FIG. 3 is a front view showing a state in which the first and second connectors are temporally fitted in the first embodiment of the present invention.
Figure 4:
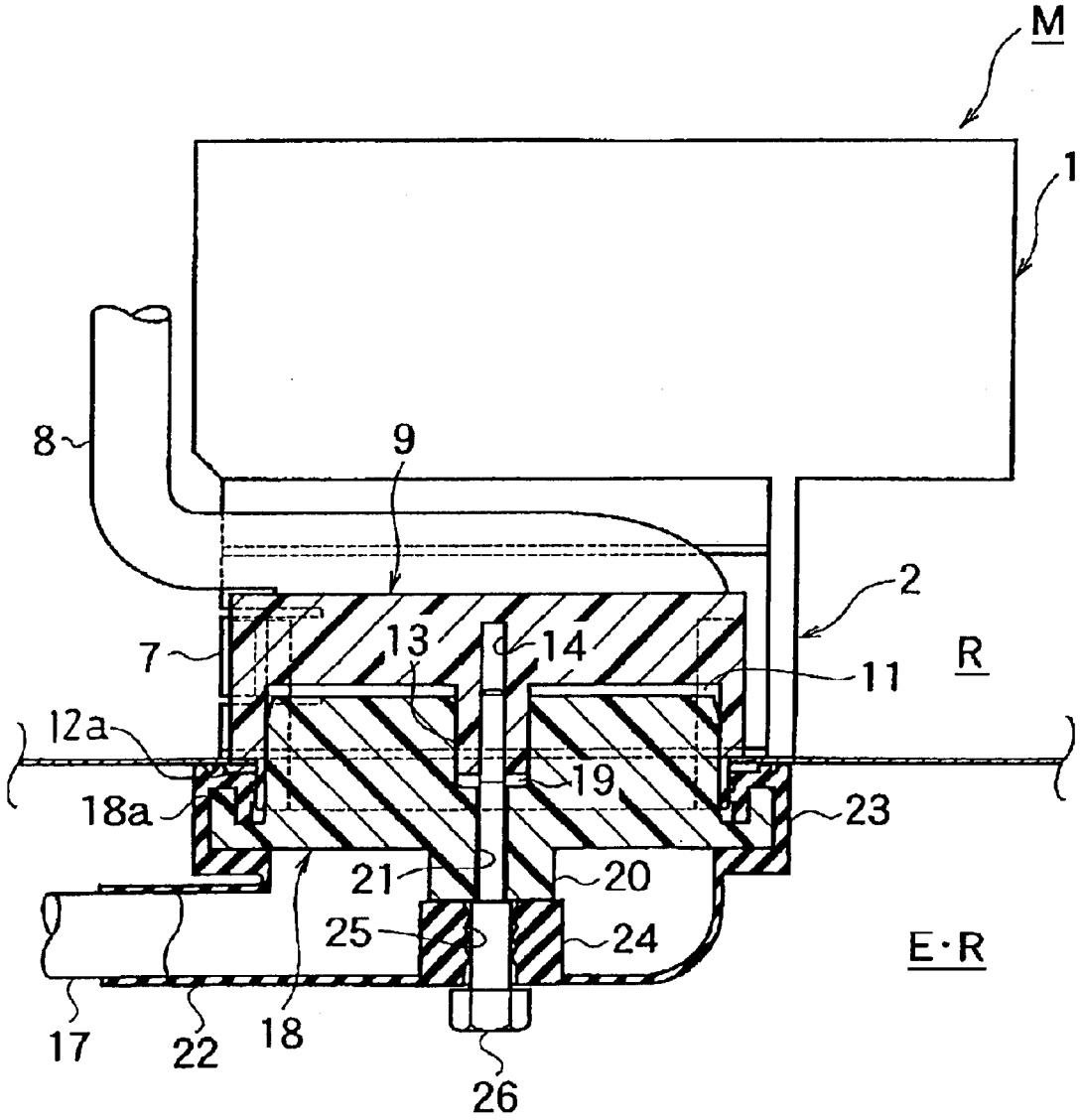
FIG. 4 is a front view showing a state in which the first and second connectors are fitted in the first embodiment of the present invention.

Referring now to FIGS. 1 to 4, a first embodiment of the present invention is shown. As shown in FIGS. 2 to 4, a vehicle such as an automobile to which the present invention is applied has a passenger compartment R, an engine room ER and a dash panel 15.

In FIGS. 1 to 4, reference numeral 1 denotes an air conditioning unit as a component of a cockpit module, disposed in the passenger compartment R. The air conditioning unit 1 is assembled in an instrument panel (not shown) to form the cockpit module M. For example, two first connectors 9 are attached on a front part of the air conditioning unit 1.

It should be noted that number of the first connectors 9 is not limited and in the embodiment shown, the first connectors 9 are disposed upwardly and downwardly and attached through a pair of connector brackets 2 to the front part of the air conditioning unit 1. The first connectors 9 are inserted into the connector brackets 2, respectively, as will be described in detail hereinafter.

These connector brackets 2 may be integrally formed with the air conditioning unit 1, for example.

In other words, each connector bracket is pre-formed corresponding to the air conditioning unit 1 and then is attached fixedly to the air conditioning unit 1.

Each connector bracket has a generally rectangular box-like shape and has a connector inserting opening 3 formed in a left side of the bracket as viewed in FIG. 1, in other words, in a right side of the vehicle and a window 4 formed in a front surface of the bracket and communicated with the connector inserting opening 3.

Guide rails 5 are arranged up and down on a side surface of each connector bracket 2 opposite to the window 4. The guide rails guide the first connector in cooperation with upper and lower edges of the window 4.

Each connector bracket has also a stopper 6 which is disposed opposite to the connector inserting opening 3 to limit movement of inserting of the first connector 9 into the connector bracket 2. It is preferable that the guide rails 5 and stoppers 6 are integrally formed with the connector brackets.

A pair of engaging hooks 7 are arranged to opposite to each other on upward and downward walls of the connector inserting opening 3 of each connector bracket 2. These engaging hooks 7 are provided by forming a pair of slits 7*a* on the upward and downward walls of the connector inserting opening 3 to deform elastically in approached and separated directions with respect to each other.

Each of the first connectors 9 has a rectangular block-like shape having a size insertable in a space between the guide rails 5 and the upper and lower edges of the window 4 of each connector bracket 2. Each first connector has also at its upper and lower surfaces engaging pieces 10 which are engageable with the engaging hooks 7 at a position where a leading end of each first connector 9 abuts with the stopper 6 to prevent the first connector 9 from removing out of the connector bracket 2.

More specifically, the engaging pieces 10 are formed to extend diagonally and upwardly in a direction spaced away from the connector bracket 2. The engaging pieces 10 are adapted to elastically connect with upper and lower inner walls of each of the connector brackets 2.

Each of the first connectors 9 is inserted into the corresponding connector bracket 2 through the connector inserting opening 3 thereof. Engaging pieces 10 are engaged with the engaging hooks 7 of the connector bracket 2 to prevent the first connector from backing out of the connector bracket 2. Thus, the first connector 9 can be sub-assembled in the connector bracket 2.

Distances between the upper and lower walls in each connector bracket 2, between the guide rails 5 respective upper and lower edges of the window 4, and between the stopper 6 and engaging hooks 7 are slightly larger than the corresponding sizes of the first connector 9. As a result, when the first connector 9 is provided in the bracket 2, the first connector 9 can be moved smoothly and adjustably in upward, downward, forward, rearward, rightward, and leftward directions in the bracket 2.

Reference numerals 8 denote two harnesses (of the passenger compartment side) which are cabled in the passenger compartment R. One end of each of these harnesses 8 is connected to a first connector 9 in a conventional manner. In turn, each first connector is inserted into and held in a corresponding connector bracket 2. As a result, the first connectors 9 are attached through the connector brackets 2 to the front part of the air conditioning unit 1 to face the dash panel 15.

Here, it is noted that each of the first connectors 9 is provided with an opening portion 11 at its front part which faces the dash panel 15. Each opening portion 11 is for inserting a corresponding second connector 18 which is disposed in the engine room ER to connect the second connector 18 with a first connector 9. Each opening portion 11 has a laterally extending elongate ellipse shape. Each of the first connectors 9 has at a periphery of the opening portion 11 a guide portion 12 which projects from a body of the first connector to guide the corresponding second connector. A portion of each of the first connectors 9 (for example, the guide portion 12) is inserted into a connector through-hole 16 which is formed in the dash panel 15, when the second connectors 18 are inserted completely in the first connectors 9, respectively (see FIG. 4).

For smooth insertion of the guide portion 12, the connector through-hole 16 has a shape corresponding to the above shape of the guide portion 12. When the guide portion is inserted into the connector through-hole 16, each first connector 9 is arranged so that a shoulder 12*a* in a base portion of the guide portion 12 abuts with the dash panel 15 within the passenger compartment, as shown in FIG. 4.

It is noted that the connector through-hole 16, which is provided for inserting both first connectors 9, is arranged in the dash panel 15 in the central part in the width direction of the vehicle, i.e., the direction corresponding to a disposed position of the air conditioning unit 1 in the cockpit module M.

Consequently, the second connectors 18 are connected with the first connectors 9 in the central part in the width direction of the vehicle.

Of course, each of the second connectors 18 has a shape and size corresponding to the respective opening portion 11 to be insertable therein.

Each of the harnesses 17 (which are cabled in the engine room ER) is connected with each of the second connectors 18 in a well known manner in order to connect the harnesses 17 with the harnesses 8 (which are cabled in the passenger compartment R when the second connectors 18 are connected with the first connectors 9).

Seal boots 22 are provided on the second connectors 18 to seal the connected portion between each second connector 18 and harness 17 connected therewith. Each of the seal boots 22 is made of an elastic material such as rubber, synthetic resin or the like. Each seal boot 22 has at an end an annular flange portion or annular sealing member 23.

Each of the second connectors 18 is provided at its one end with a flange 18*a* which is L-shaped in cross-section. Each of the seal boots 22 is mounted on each of the second connectors 18 by fitting the L-shaped flange 18*a* in the annular flange portion 23. End and inner peripheral surfaces of the annular flange portion 23 are provided with protrusions 23*a* and 23*b* for sealing, respectively.

In this embodiment, a boss 13 having a threaded hole 14 is provided at the central region within the opening portion 11 in each first connector 9.

Formed in the central portion of the connected end surface of each second connector 18 is a concave portion 19 in which the boss 13 of each first connector 9 is inserted. Each second connector 18 has also a boss 20 (which is provided on the central portion of the rear surface opposite to the corresponding first connector 9) and a bolt through-hole 21 passing through the center of the second connector and communicating with the concave portion 19. Each seal boot 22 is provided with a boss 24 which is connectable with the corresponding boss 20 and which has a bolt through-hole 25 concentric with the corresponding bolt through-hole 21.

A bolt 26 is inserted into each bolt through-hole 25, each bolt through-hole 21 and each concave portion 19. The bolts 26 are then screwed into the corresponding threaded holes 14 of the first connectors 9, when each second connector is connected with each first connector.

Each bolt through-hole 25 has an inner peripheral surface which is formed in concave and convex-like shape to cause the inserted bolt 26 to elastically hold.

A process for connecting the harnesses 8 in the passenger compartment and harnesses 17 in the engine room will be explained hereinafter.

First, prior to assembling the cockpit module M on the front part of the passenger compartment of the vehicle, the first connectors 9 (to which harnesses 8 disposed in the passenger compartment R are connected) are inserted through the connector inserting openings 3 in the connector brackets 2 and are held therein to sub-assemble the first connectors 9 on the air conditioning unit 1.

Subsequently, the cockpit module M is attached through a steering member and steering mount stay (not shown) in the front part of the passenger compartment R. At this time, the guide portion 12 of each first connector 9 is disposed to face the connector through-hole 16 in the vicinity of the dash panel 15.

Next, the second connectors 18 (which are connected to the harnesses 17 disposed in the engine room ER) are connected with the first connectors 9 by inserting the second connectors 18 through the connector through-hole 16 of the dash panel 15 and into the guide portions 12 of the opening portions 11 of the corresponding first connectors 9. At this time, as shown in FIG. 2, the bolts 26 are inserted into the bolt through-holes 25 of the seal boot 22 in each second connector 18 and into the bolt through-holes 21 in each second connector 18. In this case, the bolts 26 are held temporarily by an elasticity of the concave-convex-like shape in the bolt through-holes 25 of the bosses 24. Subsequently, the corresponding first and second connectors 9 and 18 are temporarily fitted by threading slightly the bolts 26 into the threaded holes 14 of the bosses 13 in each of the first connectors 9 in such a state that the connected end of each second connector 18 is slightly inserted into the corresponding guide portion 12 in each first connector 9.

When the corresponding first and second connectors 9 and 18 are temporarily fitted and are moved in up, down, right and left directions, the first connectors 9 are correspondingly moved in up, down, right, and left directions relative to the connector brackets 2 so that a position of each of the first connectors 9 relative to the connector through-hole 16 can be adjusted. After this adjustment of the first connectors 9 the bolt 26 for each second connector 18 is further threaded into the threaded hole 14 in each corresponding first connector 9.

As a result, fitting of the first and second connectors proceeds as the bolt 26 is threaded in the threaded hole 14 and then the guide portion 12 of each first connector 9 is fitted passing through the connector through-hole 16 into a space between the outer peripheral surface of each second connector 18 and the inner peripheral surface of the annular flange portion 23 of the second connector (see FIG. 4).

At this time, the annular flange portion 23 of each second connector 18 and the shoulder 12*a* of each first connector 9 hold the peripheral portion of the connector through-hole 16 of the dash panel 15 under action of a force to seal the connector through-hole 16 and the space between the first and second connectors 9 and 18. The seal is maintained by an elastic deformation of the annular flange portion 23 due to the above force.

As described above, by the fact that the first and second connectors are fastened by the bolts 26, since each first connector is movable forwardly and rearwardly relative to the corresponding connector bracket 2, a correct fitting of the first and second connectors 9 and 18 can be performed regardless of an error of an attached position of the cockpit module M in forward and rearward directions (directions toward to and away from the dash panel).

As described above, according to the first embodiment, when the cockpit module M is installed in the front part of the passenger compartment R, each of the first connectors 9 (which are mounted on the connector brackets 2 at the front part of the air conditioning unit 1 which is the component of the cockpit module) is arranged to face the connector through-hole 16 of the dash panel 15.

It is, therefore, possible to fit easily each second connector 18 in each first connector 9 from the engine room ER having a relatively wide space for working to connect the harnesses 17 in the engine room ER with the harnesses 8 in the passenger compartment R through the first and second connectors 9 and 18.

It is also possible to ensure a more wide space for working since operation for fitting the first and second connectors 9 and 18 can be carried out in the central part in the width direction of the vehicle.

Consequently, it is possible to easily perform the connection of the harnesses and to enhance workability for connecting the harnesses without a worker taking an impossible position as in prior art in which working for connecting harnesses has been carried out in narrow corners such as right and left sides or a narrow space below an instrument panel.

Especially, in this embodiment, because the first connectors 9 are movably and adjustably installed in forward, rearward, rightward, leftward, upward, and downward directions relative to the second connectors 18, it is possible to correctly position each of the first connectors 9 relative to the connector through-hole 16 of the dash panel 15 by moving adjustably the first connection in forward, rearward, rightward, leftward, upward, and downward directions. Therefore, it is possible to connect properly the first and second connectors 9 and 18 with absorption of an error in assembling of the air conditioning unit 1.

It is also possible to further easily carry out the connection of the second connectors 18 with the first connectors 9, since the insertion of each second connector 18 into the first connector can be guided with the guide portion 12 of the first connector.

Further, because the peripheral portion of the connector through-hole 16 for each first connector in the dash panel 15 is held by the first and second connectors 9 and 18, it is possible to enhance stability for supporting the air conditioning unit 1 relative to the dash panel 15 under a force and to seal firmly the peripheral portion of the connector through-hole 16 and fitting portions between the first and second connectors 9 and 18 by deforming elastically the flange portion 23 in each second connector 18 under the above force.

In the above embodiment, although the first and second connectors are fastened by the bolts 26, other suitable means, for example, a clip means comprising an engaging hook and an engaging portion engaged with the engaging hook may be applied. As a sequence of connection events, the first connectors 9 are first inserted into the connector brackets 2, then the guide portions 12 of the first connectors 9 are inserted into the through-hole 16 (or separate through-holes 16) in the dash panel 15 thereby exposing the opening portion 11 of each first connector 9, and then each of the second connectors 18 may be inserted into the corresponding opening portion 11 to connect the first and second connectors 9 and 18.

Further, the connector brackets 2 may be fixed to the air conditioning unit 1 by means of suitable means such as an engaging hook and so on.

Figure 5:
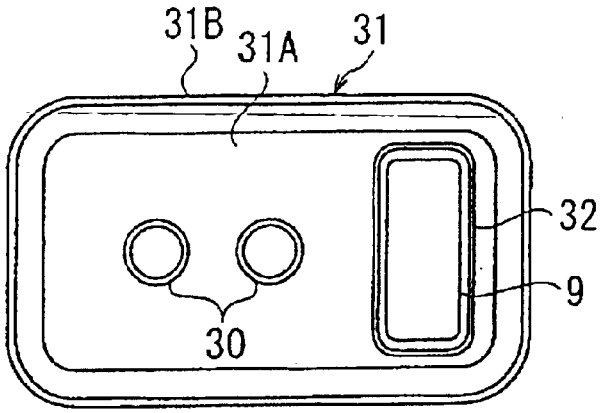
FIG. 5 is a front view showing a sealing part of wiring in a second embodiment of the present invention.
Figure 6:
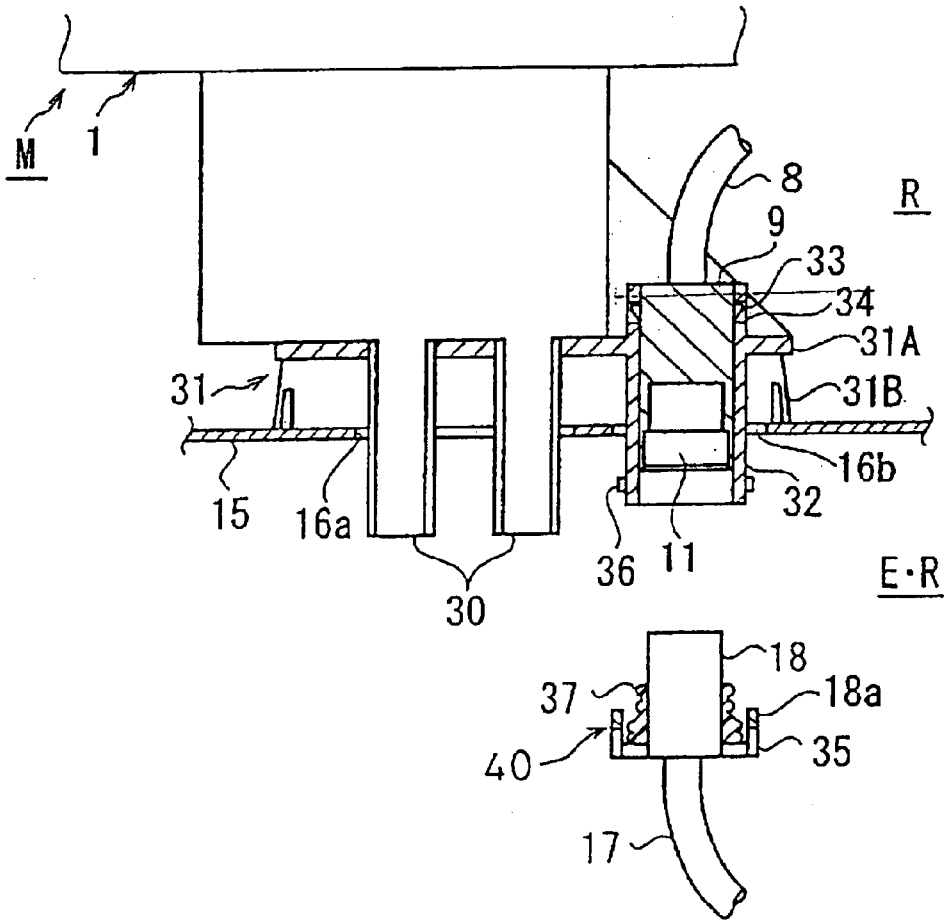
FIG. 6 is a sectional view showing a state before first and second connectors are fitted in the second embodiment of the present invention.

FIGS. 5 and 6 show a second embodiment of the present invention. In FIGS. 5 and 6, the same reference numerals are annexed to the same parts shown in FIGS. 1 to 4. In this second embodiment, a first connector 9 is attached to a sealing portion 31 of coolant pipings 30 in an air conditioning unit 1 of a cockpit module M (which is disposed in a passenger compartment R as described in the first embodiment). A harness 8, is cabled in the passenger compartment R, is connected with the first connector 9.

The sealing portion 31 is provided with a seat 31A, an annular seal lip 31 B provided on a periphery of the seat and a socket portion 32 formed integrally with the seat for inserting the first connector 9. The socket portion 32 performs the same function as the connector brackets 2 in the first embodiment.

The first connector 9 is inserted into the socket portion 32 from the rear side thereof opposite a dash panel 15 as shown in FIG. 6. The first connector 9 is provided at its rear end with engaging hooks 33 which are inserted into engaging holes 34 provided in the socket portion 32 to sub-assemble the first connector 9 in the socket portion 32. The socket portion 32 has at its front portion an opening portion 11 for inserting a second connector 18. A harness 17 which is cabled in an engine room ER is connected with the second connector 18.

The second connector 18 which is connected with the first connector 9 is provided with a socket 40 which is arranged at a periphery of the second connector 18. The socket 40 has an annular flange 18*a*. When the second connector 18 is inserted into the opening portion 11, a leading portion of the socket portion 32 is inserted into a space between the second connector 18 and the annular flange 18*a* of the socket 40. The socket portion 32 is provided with protrusions 36 which are inserted into holes 35 provided in the socket 40 to prevent the second connector from backing out of the opening portion 11. Sealing of a connected portion between the first and second connectors 9 and 18 is carried out by a seal rubber 37 which is disposed in the space between the second connector 18 and the annular flange 18*a*.

In this second embodiment, when the air conditioning unit 1 is installed in a front part of the passenger compartment R, the coolant pipings 30 and the socket portion 32 project through through-holes 16*a* and 16*b* in the dash panel 15, respectively, into the engine room ER. The seal lip 31B is fixed to the dash panel 15 in such a manner that it abuts with the dash panel 15.

Next, the second connector 18 is inserted into the socket portion 32 from the engine room ER to connect with the first connector 9. In this case, the first and second connectors 9 and 18 are firmly connected by engagement of the engaging hooks 36 and engaging holes 35.

Although the first and second embodiments have been explained, it should be noted that various changes and modifications can be applied to the aforementioned embodiments without departing from the scope of the present invention as claimed in claims.

What is claimed is:

1. A structure for connection harnesses in a vehicle comprising:

a cockpit module including a component which is assembled in an instrument panel disposed in a passenger compartment;

a first connector which is connected with an end of a harness disposed in said passenger compartment and which is attached to said component of the cockpit module;

a second connector which is connected with an end of a harness disposed in an engine room and which is connectable with said first connector;

a dash panel which divides said passenger compartment and engine room and which has a connector through-hole in which a portion of said first connector is inserted; and a connector bracket to which said first connector is attached and which is attached to said component of said cockpit module, wherein said first connector is arranged to face said connector through-hole when said cockpit module is attached in a front part of said passenger compartment and said second connector is connectable with said first connector from said engine room, and wherein said first connector is mounted adjustably and movably in forward, rearward, upward, downward, rightward, and leftward directions on said connector bracket.

2. A structure for connection harnesses in a vehicle according to claim 1, wherein said connector bracket is integrally formed on a front surface of said component.

3. A structure for connection harnesses in a vehicle according to claim 1, wherein said first connector has a guide part for inserting said second connector.

4. A structure for connection harnesses in a vehicle according to claim 1, wherein said first and second connectors hold together an a peripheral part of the connector through-hole of said dash panel.

5. A structure for connection harnesses in a vehicle according to claim 1, wherein said second connector is provided with an annular sealing member which is subjected to a force occurred between both the connectors when the second connector is connected with the first connector, said annular sealing member sealing the peripheral part of the connector through-hole and a periphery of a fitting part in both the connectors under action of a force of holding the dash panel by said first and second connectors.

6. A structure for connection harnesses in a vehicle according to claim 1, wherein said first and second connectors are connected at a central part of the dash panel in a direction of width of the vehicle.

7. A structure for connection harnesses in a vehicle according to claim 1, wherein said first connector has a guide part for inserting said second connector.

8. A structure for connection harnesses in a vehicle according to claim 1, wherein said first and second connectors are configured to be held together at a peripheral part of the connector through-hole of said dash panel.

9. A structure for connection harnesses in a vehicle according to claim 1, wherein said first and second connectors are connected at a central part of the dash panel in a direction of width of the vehicle.

* * * * *